US011363845B2

(12) United States Patent
Newman et al.

(10) Patent No.: US 11,363,845 B2
(45) Date of Patent: Jun. 21, 2022

(54) GLOVE WITH ELASTIC BACKFINGER

(71) Applicant: Rawlings Sporting Goods Company, Inc., St. Louis, MO (US)

(72) Inventors: Robert Newman, St. Peters, MO (US); Anton Sutovsky, St. Louis, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 220 days.

(21) Appl. No.: 16/797,397

(22) Filed: Feb. 21, 2020

(65) Prior Publication Data

US 2020/0268075 A1 Aug. 27, 2020

Related U.S. Application Data

(60) Provisional application No. 62/809,801, filed on Feb. 25, 2019.

(51) Int. Cl.

| | |
|---|---|
| ***A41D 19/00*** | (2006.01) |
| ***A41D 31/18*** | (2019.01) |
| ***A63B 71/14*** | (2006.01) |
| ***A41D 31/14*** | (2019.01) |

(52) U.S. Cl.

CPC ..... *A41D 19/0006* (2013.01); *A41D 19/001* (2013.01); *A41D 31/145* (2019.02); *A41D 31/185* (2019.02); *A63B 71/143* (2013.01); *A63B 2209/00* (2013.01)

(58) Field of Classification Search

CPC . A41D 19/0006; A41D 19/001; A63B 71/143

See application file for complete search history.

(56) References Cited

U.S. PATENT DOCUMENTS

| | | | | |
|---|---|---|---|---|
| 3,300,787 | A * | 1/1967 | Denkert | A63B 71/143 2/19 |
| 6,415,444 | B1 * | 7/2002 | Kleinert | A41D 19/015 2/161.1 |
| 6,681,402 | B1 * | 1/2004 | Bevier | A41D 19/01523 2/19 |
| 9,211,467 | B2 * | 12/2015 | McNamee | A63B 71/143 |
| 2003/0056273 | A1 * | 3/2003 | Kleinert | A63B 71/143 2/19 |
| 2003/0101501 | A1 * | 6/2003 | Sullivano | A63B 71/143 2/19 |
| 2009/0193560 | A1 * | 8/2009 | Provezano | A63B 71/14 2/21 |
| 2014/0259257 | A1 * | 9/2014 | Hewitt | A63B 71/143 2/19 |
| 2018/0078842 | A1 * | 3/2018 | Dueck | A41D 19/01523 |

* cited by examiner

*Primary Examiner* — Tajash D Patel

(57) ABSTRACT

The present invention provides a lightweight glove for baseball or softball that may include an elastic backfinger to provide a conforming fit to the wearer's hand. In general, the elastic backfinger may replace existing, often leather backfingers, the back panel, the liner, and/or other elements of traditional gloves glove with the elastic material, combination of elastic materials, or combination of elastic and inelastic materials.

17 Claims, 3 Drawing Sheets

GLOVE WITH ELASTIC BACKFINGER

CROSS-REFERENCE TO RELATED APPLICATIONS

This Applications claims priority to U.S. Provisional Patent Application Ser. No. 62/809,801, filed on Feb. 25, 2019, entitled "Glove with Elastic Backfinger," the entire disclosure of which is incorporated herein by reference.

FIELD OF THE INVENTION

The present invention relates to sports equipment and, more particularly, to a glove for baseball or softball. The present invention is specifically directed to a lightweight glove for baseball or softball with an elastic backfinger that provides a conforming fit to the wearer's hand so as to increase the glove's comfort.

BACKGROUND OF THE INVENTION

As provided in FIG. 1, a conventional glove 100 for baseball or softball generally comprises a thumb portion 105 and four finger portions 110. The finger portions 110 are conventionally joined by cross-bracing and form a conjoined finger region. The cross-bracing may include, but is not limited to, cords and the like. A web is located between and secured to, by fastening means, the thumb portion 105 and finger portions 110. A front panel (not shown) forms the front wall of the glove 100 and a back panel 115 forms the back wall of the glove 100. The front and back panels are secured together at peripheral margins of the glove 100 by various fastening means to form a glove shell 120 having a top, bottom, and opposite sides. The fastening means may include, but are not limited to, stitching, cords, clasps, rivets, glue, and other fastening means.

The lower edge of the back panel 115 includes an opening 125 for receiving the wearer's hand and may further comprise an adjustable strap or thong 130 that extends across the opening 125. The adjustable strap or thong 130 typically comprises a hook-and-ring type fastener, a pull strap, a Velcro strap, or the like for selectively securing the wearer's hand in the glove 100 during use. The front and back panels being preferably constructed of relatively thick, dense, and stiff material for structural integrity and shock absorbing purposes.

As provided in FIG. 2, the glove shell 120 generally defines an inner thumb stall 135 and inner finger stalls 140. The thumb stall 135 is formed within the thumb portion 105, and the finger stalls 140 are formed within the finger portions 110.

Conventional gloves 100 for baseball or softball further comprise a liner 145. The liner 145, which is traditionally made from a leather material include a thumb liner 150 for receiving the thumb of the hand of the wearer and finger liners 155 for receiving the fingers of the hand of the wearer. With respect to the shell 120, the liner 145 comprises a palm liner panel on the inside face of the front panel, and the thumb liner 150 and finger liners 155 may generally reside in the thumb stall 135 and finger stalls 140, respectively, of the glove shell 120.

Certain gloves do not contain a liner 145 or conventional thumb liner 150 and finger liners 155 defined thereby. Instead, such gloves comprise a single compartment or stall for receiving at least one of the wearer's fingers to allow for the provision of additional material and padding to cover the wearer's hand and palm. Such gloves are generally adapted for use by catchers or first basemen and provide desirable shock-absorbing effects. However, such gloves have not been effectively applied to gloves worn by other players, including, without limitation, gloves for pitchers, catchers, first basemen, infielders, outfielders, and the like.

The front panel and the palm liner have lower edge margins generally in registry with one another to form a heel of the glove 100 extending between the opposite sides of the glove 100. The front panel has an outside face forming the front surface of the glove 100 and an inside face. The outside face of the front panel has a central portion forming a ball-catching pocket located above the heel of the glove 100 and below the web and the finger portions 110. The back panel 115 has an outside face enclosing the thumb stall 135 and finger stalls 140 of the glove shell 120. The back panel 115 may also cover the thumb portion 105 and finger portions 110 and generally form a backfinger 160. The backfinger 160 typically comprises a continuous piece of material or composite material that may generally be defined by an interior (not illustrated) of the back panel 115.

Gloves constructed in conventional fashion are heavy, lack adequate breathability, and do not provide adequate means for conforming the glove to the wearer's hand during use. Generally, conventionally constructed gloves are comprised entirely or mostly of leather and/or leather-like materials, which are generally relatively dense and stiff materials. Use of such dense material or materials in the construction of a glove for baseball or softball creates a relatively heavy glove, especially for gloves that comprise additional padding or lengths of materials, such as gloves for catchers or outfielders. Additionally, in general, the leather and/or leather-like materials are not adequately breathable and limit the flow of air onto and around the wearer's hand when the glove is in use.

Further, known gloves for baseball or softball comprise extra or superfluous material for purposes of meeting desired specifications and dimensions. For example, the finger elements corresponding with the thumb stall and finger stalls of known gloves comprise dense leather or leather-like material, internal padding, structural support, fastening means, and cross-bracing, which adds to the overall weight of the glove. When a wearer inserts his or her hand into a glove for baseball or softball, the wearer's fingers extend only partially into the thumb stall or finger stalls, and at least fifty percent (50%) of the thumb or fingers of conventional gloves for baseball or softball are designed for purposes other than receiving the wearer's fingers. It is those portions of thumb and fingers that comprise the extra or superfluous material, which increases the glove's weight and limits the ease of use of such gloves. Additionally, gloves constructed for baseball or softball for professional-level competition generally may include even more leather or leather-like materials to provide additional length, padding, and structural support.

Further, the backfinger, the back panel, the liner, and other elements of known gloves comprise stiff material that generally inhibits the optimal fit and breathability of the gloves. For example, the backfinger or the back panel of known gloves comprise leather or leather-like material that has limited flexibility and does not permit adequate flow of air onto and around the wearer's hand. Further, although the leather or leather-like material of the front panel of known gloves may become less stiff over time through the process of breaking in the palm or forming the pocket of the glove, the material of the backfinger and back panel of known gloves generally remains relatively stiff over the lifetime of the glove.

Therefore, a need exists for a breathable, lightweight glove with a conforming fit to optimize utility of the glove while also using fewer materials compared to known gloves.

SUMMARY OF THE INVENTION

The present invention relates to a lightweight glove for baseball or softball that generally comprises a lightweight and elastic backfinger and provides a conforming fit to the wearer's hand. The reduced weight of the glove provides superior ease of use, as well as other advantages. Further, the conforming fit of the glove provides improved utility and performance, among other advantages.

In general, the elastic backfinger comprises an elastic material, a combination of elastic materials, or a combination of elastic and inelastic materials. The elastic backfinger can be achieved by at least partially replacing the backfinger, the back panel, the liner, and/or other elements of the glove with the elastic material, combination of elastic materials, or combination of elastic and inelastic materials.

The objects of this invention are as follows: (i) to provide a lightweight glove, (ii) to provide a glove with an improved fit for the wearer, (iii) to provide a glove with improved breathability, and (iv) to provide a glove that utilizes fewer materials compared to known gloves. Other advantages and objects of the invention will become apparent from the following description with reference to the accompanying drawings.

BRIEF DESCRIPTION OF THE DRAWINGS

For a better understanding of the various embodiments of the present invention, reference may be made to the accompanying drawings in which.

Figure 1:
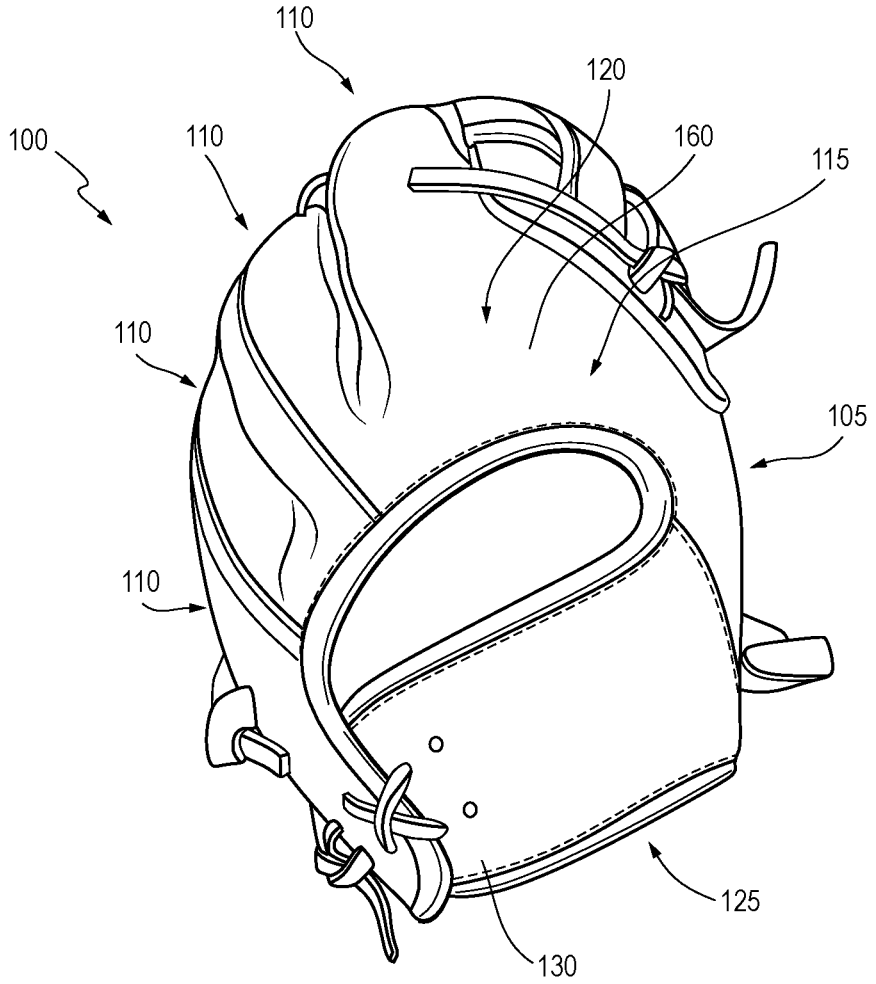
FIG. 1 is a perspective view of a prior art glove.
Figure 2:
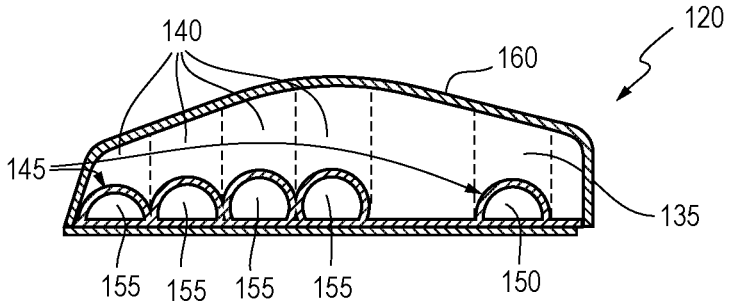
FIG. 2 is a cross-section view of the prior art glove of FIG. 1.

While the disclosure is susceptible to various modifications and alternative forms, specific embodiments thereof are shown by way of example in the drawing and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be understood that any dimensions included in the figures are simply provided as examples and dimensions other than those provided therein are also within the scope of the invention.

The description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

One objective of the present invention is to provide a glove for baseball or softball with (i) a reduced weight, (ii) an improved fit for the wearer, (iii) improved breathability, and (iv) less materials compared to known gloves. Further, another objective of the present invention is to provide a glove for baseball or softball that is an improvement over known gloves for baseball or softball.

Figure 3:
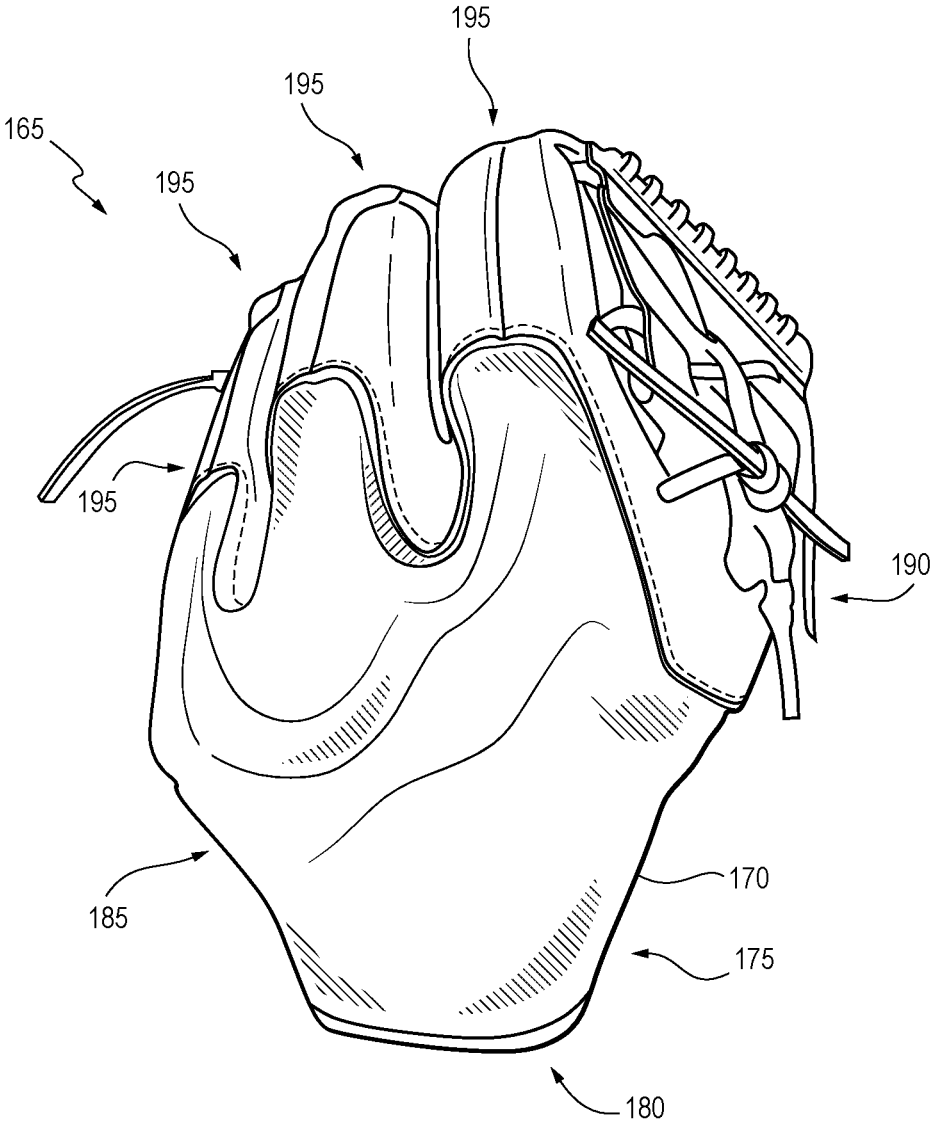
FIG. 3 is a perspective view of a first embodiment of a glove having an elastic backfinger constructed according to the teachings of the present invention.

The present invention is directed to an improved lightweight glove 165, as illustrated in FIG. 3. The glove 165, like the glove 1, may be used for baseball or softball. The glove 165 improves upon the prior art glove 1 at least in part by including an elastic backfinger 170 that helps to provide a conforming fit to the wearer's hand. The improved elastic backfinger 170 generally comprises, at least in part, a lightweight elastic material, a combination of elastic materials, or a combination of breathable elastic and breathable inelastic materials. The lightweight and breathable elastic material, combination of elastic materials, or combination of elastic and inelastic materials are designed to replace at least a portion of the dense and stiff material comprising the back panel (not shown), the liner 145, and/or other elements of known gloves 100, including the extra or superfluous material of known gloves 100. The lightweight substitution of material or combination of materials may further comprise breathable materials for purposes of facilitating the flow of air onto and/or around the wearer's hand when the glove is in use and, in some embodiments, may generally comprise an elastic mesh-like material.

In a preferred embodiment, the elastic material, combination of elastic materials, or combination of elastic and inelastic materials of the backfinger 170 serve a general purpose similar to that of the back panel 115 of the prior art glove 100. As best illustrated in FIG. 3, in some embodiments, the improved backfinger 170 of the improved glove 100' may comprise a combination of elastic and inelastic materials, wherein a lower portion 175 of the elastic material may define an opening 180 for receiving the wearer's hand defined thereby. In these embodiments, the improved backfinger 170 substantially comprises a continuous piece of elastic material, extending from the opening 180 of a back panel 185 of the glove 165 to thumb portion 190 and finger portions 195. In a preferred embodiment, the thumb portion 190 and the finger portions 195 covered by the backfinger 170 may correspond with where the wearer's hand and fingers extend therein, approximately half of the length of the thumb portion 190 and the finger portions 195. In such an embodiment, the elastic material may extend to and be joined with non-elastic portions of the thumb portion 190 or finger portions 195 of the back panel 185, which may be similar to the thumb portion 105 or finger portions 110 of conventional gloves like the glove 100 that are adapted for purposes other than receiving the wearer's finger. In alternative embodiments, the thumb portion 190 and the finger portions 195 covered by the backfinger 170 may vary greatly, including the entirety of the thumb portion 190 and the finger portions 195 being covered by the material of the backfinger 170.

Figure 4:
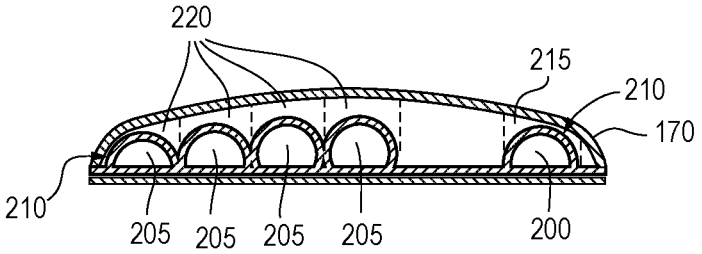
FIG. 4 is a cross-section view of the glove of FIG. 3.

With respect to the embodiment depicted in FIGS. 3 and 4, the wearer inserts his or her hand into opening 180. Then, the wearer may insert his or her thumb and fingers into a thumb liner 200 substantially similar to the thumb liner 150 of the prior art glove 100 and finger liners 205 substantially similar to the finger liners 155 of the prior art glove 100, both of which may be formed from a liner 210 of the glove 165 similar to the liner 145 of the prior art glove 1. The thumb liner 200 and finger liners 205 may also be received in a thumb stall 215 and finger stalls 220, which are substantially similar to the stalls 135, 140 of the prior art glove 100.

Thus, the elastic material of the improved backfinger 170 may generally cover and compressingly engage the thumb liner 200 and finger liners 205 of the glove 165. As such, when the wearer inserts his or her hand into the glove 160, the elastic material of the improved elastic backfinger 170 compressingly secures the hand of the wearer, such that the use of an adjustable strap or thong for selectively securing the glove to the wearer's hand is not necessary. Although the backfinger 170 is depicted in FIG. 3 as not comprising an adjustable strap or thong, it will be understood that the backfinger 170 may include an adjustable strap or thong.

Figure 5:
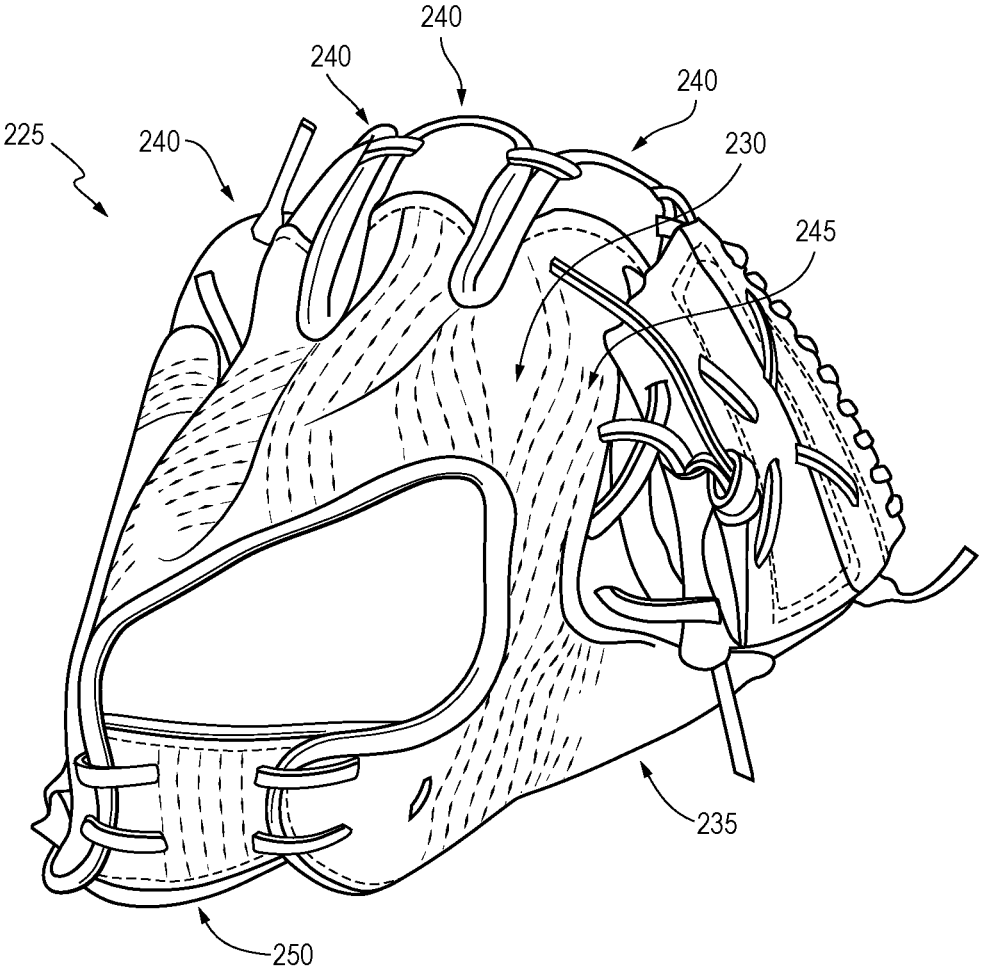
FIG. 5 is a perspective view of a second embodiment of a glove having an elastic backfinger constructed according to the teachings of the present invention.

Yet another embodiment of a glove, glove 225 is illustrated in FIG. 5. The glove 225 preferably includes a backfinger 230 that is attached to a thumb portion 235 and finger portions 240 of the glove 225 on a back panel 245. Like the other gloves 100, 165, the glove 225 includes an opening 250 through which a wearer may insert his or her hand.

Figure 6:
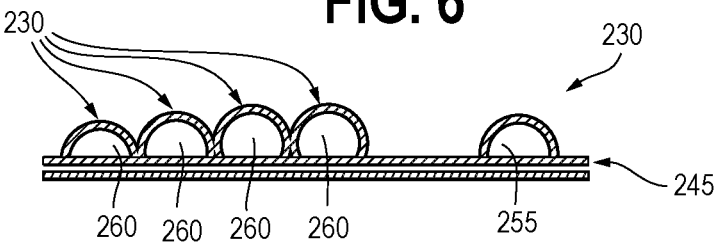
FIG. 6 is a cross-section view of the glove of FIG. 5.

Unlike the other described gloves 100, 165, and as illustrated in FIG. 6, the backfinger 230 itself defines a thumb stall 255 and finger stalls 260. In the glove 225, there are no separate thumb and finger liners defined thereby. Rather the backfinger is directly attachable to the back panel 245. The improved backfinger 230 of the glove 225 may comprise a continuous piece of elastic material extending from the lower edge of the back panel 245. In this embodiment, the continuous piece of elastic material extends over most or all of the length of the thumb portion 235 and finger portions 140.

With respect to the embodiment depicted by FIGS. 5 and 6, the wearer inserts his or her hand into opening 250 and respective fingers into the thumb stall 255 and finger stalls 260, such that the elastic material of the improved backfinger 230 may generally cover and compressingly secure the hand, thumb, and fingers of the wearer directly on the back panel 245. The direct compression on the wearer's hand, thumb, and fingers provides for a superior fit when compared to known gloves 100 for baseball or softball. It will be understood that the improved glove 225 of such embodiments does not require the use of an adjustable strap or thong, though the glove 225 may include an adjustable strap or thong in at least one embodiment.

The above-described embodiments of the present invention provide for (i) the substitution of lightweight material in place of dense leather or leather-like material of conventional gloves, (ii) an improved conforming fit to the wearer's hand, and (iii) increased breathability onto and around the wearer's hand when the glove is in use. The gloves 165, 225 are also at least as adequately suitable as existing materials comprising the back panel and backfinger of known gloves for baseball or softball.

Although the present invention is discussed and depicted here as particular embodiments, it will be understood that the present invention can apply to all gloves for baseball or softball, including, but not limited to, gloves or mitts for pitchers, catchers, first basemen, infielders, outfielders, and the like.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A glove comprising:

a backfinger;

a thumb stall defined by the backfinger;

a plurality of finger stalls defined by the backfinger;

a liner;

a thumb liner defined by the liner; and a plurality of finger liners defined by the liner;

wherein the thumb liner and the plurality of finger liners are received in the backfinger;

wherein the backfinger comprises an elastic material;

wherein the backfinger is adapted to compressingly engage the thumb liner and the plurality of finger liners; and wherein the backfinger is adapted to compressingly secure a hand received by the thumb stall and the plurality of finger stalls.

2. The glove of claim 1, wherein the thumb liner and the plurality of finger liners are adapted to receive the hand.

3. The glove of claim 1, wherein the thumb stall is adapted to receive the thumb liner.

4. The glove of claim 1, wherein the plurality of finger stalls are adapted to receive the plurality of finger liners.

5. The glove of claim 1, wherein the backfinger further comprises a breathable material.

6. The glove of claim 1, wherein the elastic material is a mesh-like material.

7. The glove of claim 1, wherein the backfinger further comprises an inelastic material.

8. The glove of claim 7, wherein the thumb liner and the plurality of finger liners are adapted to receive the hand.

9. The glove of claim 8, wherein the thumb stall is adapted to receive the thumb liner.

10. The glove of claim 8, wherein the plurality of finger stalls are adapted to receive the plurality of finger liners.

11. The glove of claim 7, wherein the backfinger further comprises a breathable material.

12. The glove of claim 7, wherein the elastic material is a mesh-like material.

13. A glove comprising:

a front panel and a back panel, the front panel and the back panel each having a top portion and first and second side portions, the front panel and the back panel being affixed to each other by a fastener at their respective top portions, first side portions, and said second side portions, said front panel and back panel not being connected at respective bottom portions thereof, forming an opening there between;

a liner;

a thumb liner defined by the liner; and a plurality of finger liners defined by the liner;

wherein the back panel includes an elastic backfinger so as to compressingly secure a hand received in the opening;

wherein the thumb liner and the plurality of finger liners are received in the backfinger; and wherein the backfinger is adapted to compressingly engage the thumb liner and the plurality of finger liners.

14. The glove of claim 13, wherein the elastic backfinger defines a thumb stall and a plurality of finger stalls.

15. The glove of claim 13, wherein the backfinger further comprises a breathable material.

16. The glove of claim 13, wherein the elastic is a mesh-like material.

17. The glove of claim 13, wherein the backfinger further comprises an inelastic material.

* * * * *